United States Patent [19]

Hasker et al.

[11] Patent Number: 4,594,220

[45] Date of Patent: Jun. 10, 1986

[54] METHOD OF MANUFACTURING A SCANDATE DISPENSER CATHODE AND DISPENSER CATHODE MANUFACTURED BY MEANS OF THE METHOD

[75] Inventors: Jan Hasker; Pieter Hokkeling; Johannes van Esdonk; Josef J. van Lith, all of Eindhoven, Netherlands

[73] Assignee: U.S. Philips Corporation, New York, N.Y.

[21] Appl. No.: 685,678

[22] Filed: Dec. 24, 1984

[30] Foreign Application Priority Data

Oct. 5, 1984 [NL] Netherlands ..... 8403032

[51] Int. Cl.[4] ..... B22F 3/26

[52] U.S. Cl. ..... 419/27; 75/0.5 R; 75/0.5 BB; 75/96; 252/521; 313/337; 313/346 R; 419/31; 419/32; 419/33; 419/34; 419/35; 419/39; 419/44; 419/45; 419/54; 419/55; 419/57; 419/58; 419/60; 445/50

[58] Field of Search ..... 445/50; 313/346 R, 337; 252/521; 75/0.5 R, 96, 0.5 BB; 419/27, 31, 32, 33, 34, 35, 39, 44, 45, 54, 55, 57, 58, 60

[56] References Cited

U.S. PATENT DOCUMENTS 3,899,325 8/1975 Harrison ..... 419/6

4,007,393 2/1977 Stratum et al. ..... 313/346 R

*Primary Examiner*—Stephen J. Lechert, Jr.

*Attorney, Agent, or Firm*—Norman N. Spain

[57] ABSTRACT

A method of manufacturing a scandate dispenser cathode having a matrix at least the top layer of which at the surface consists substantially of tungsten (W) and scandium oxide ($Sc_2O_3$) and with emitter material in or below said matrix. If said method comprises the following steps:

(a) compressing a porous plug of tungsten powder (b) heating said plug in a non-reactive atmosphere and in contact with scandium to above the melting temperature of scandium, (c) cooling the plug in a hydrogen ($H_2$) atmosphere (d) pulverizing the plug to fragments (e) heating said fragments to approximately 800° C. and firing them at this temperature for a few to a few tens of minutes in a hydrogen atmosphere and slowly cooling in said hydrogen atmosphere (f) grinding the fragments to scandium hydride-tungsten powder ($ScH_2/W$)

(g) compressing a matrix or a top layer on a matrix of pure tungsten from said $ScH_2/W$ powder or from a mixture of this powder with tungsten powder (h) sintering and cooling the said matrix (i) bringing emissive material into the cathode, a scandate dispenser cathode is obtained the recovery of which after ion bombardment occurs better than in cathodes having $Sc_2O_3$ grains. The scandium is also distributed more homogeneously in the cathode than in cathodes having $Sc_2O_3$ grains.

12 Claims, 2 Drawing Figures

Figure 1:
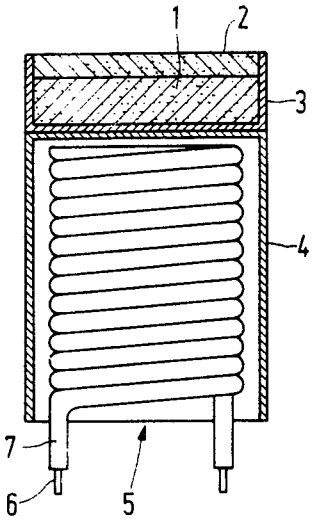

METHOD OF MANUFACTURING A SCANDATE DISPENSER CATHODE AND DISPENSER CATHODE MANUFACTURED BY MEANS OF THE METHOD

BACKGROUND OF THE INVENTION

The invention relates to a method of manufacturing a scandate dispenser cathode having a matrix at least the top layer of which at the surface consists substantially of tungsten (W) and scandium oxide ($Sc_2O_3$), and having emissive material in or below said matrix.

The invention also relates to a scandate dispenser cathode manufactured by means of this method.

The invention moreover relates to a method of manufacturing a powder of tungsten grains which are covered at least partly with scandium hydride ($ScH_2$).

Such cathodes are used as an electron source in display tubes, camera tubes, oscilloscope tubes, klystrons, transmitter tubes, etc.

A characteristic of such dispenser cathodes is that there is a functional separation between on the one hand the electron emissive surface and on the other hand a store of the emissive material which serves to produce a sufficiently low work function of said emissive surface. One type of a dispenser cathode is the L-cathode. The emission of an L-cathode takes place from the surface of a porous matrix of, for example, tungsten, the work function of which is reduced by adsorbed barium (Ba) and oxygen (O). Below its matrix the L-cathode has a storage space in which a mixture of tungsten powder and emissive material, for example, barium-calcium aluminate, is present. The adsorbate at the surface is maintained by means of reactions of this mixture.

A second type of dispenser cathode is the impregnated cathode which is obtained by impregnating a compressed and sintered porous tungsten body with emissive material. In this case the required adsorbate is obtained by means of a reaction of the emissive material with the tungsten of the matrix.

A method of the type described in the opening paragraph is known from Netherlands Patent Application No. 8201371 (PHN 10,308) laid open to public inspection which may be considered to be incorporated herein. The advantages of the dispenser cathodes manufactured according to this known method are a good life and a reasonable to moderate recovery after ion bombardment.

It is therefore an object of the invention to provide a method of manufacturing a scandate dispenser cathode the recovery of which after ion bombardment is improved. Another object of the invention is to provide a cathode in which the scandium is distributed more homogeneously in the tungsten than in cathodes comprising scandium oxide grains.

Still a further object of the invention is to provide a method of manufacturing a powder consisting of tungsten grains which are covered at least partly with scandium hydride, which powder is of use in the manufacturing of a scandate dispenser cathode.

A method of the kind described in the opening paragraph is characterized according to the invention in that it comprises the following steps:

(a) compressing a porous plug of tungsten powder;
(b) heating said plug in a non-reactive atmosphere and in contact with scandium to above the melting temperature of scandium;

(c) cooling the plug in a hydrogen ($H_2$) atmosphere;
(d) pulverizing the plug to form fragments;
(e) heating the fragments to approximately 800° C. and firing at this temperature for a few to a few tens of minutes in a hydrogen atmosphere and then slowly cooling the fragments in hydrogen atmosphere;
grinding the fragments the scandium hydride-tungsten ($ScH_2$/W) fragments to a powder;
(g) compressing a matrix or a top layer on a matrix of pure tungsten from said $ScH_2$/W powder or from a mixture of said powder with tungsten powder;
(h) sintering and cooling this matrix to form a cathode and
(i) introducing emissive material into the cathode.

Experiments have demonstrated that a coating of the order of magnitude of a mono-layer of barium on bulk scandium oxide does not give rise to a high emission. Furthermore, the reaction of scandium oxide with tungsten and tungsten oxide is of importance for the oxygen concentration on the surface of the cathode. It is hence of importance to have scandium oxide in contact with tungsten. The use of scandium oxide grains does not seem the best solution for this purpose, because in fact the core of the grain will yet not contribute to the desired processes. By using the method according to the invention, the tungsten grains in the cathode surface are partly covered with scandium oxide or scandium having scandium oxide thereon. As a result, a more homogeneous distribution of scandium over the cathode surface is also obtained than is the case when a mixture of scandium oxide grains and tungsten grains is used.

The compression of a porous plug of tungsten powder (step a) is carried out, for example, to a density of approximately 60% of the density of tungsten metal.

Heating the plug (step b) is done in a non-reactive atmosphere, but preferably in a vacuum, because then a good coating of the tungsten with scandium is obtained. Thus coating is obtained by heating the plug in contact with scandium to above the melting temperature of scandium, as a result of which the melted scandium is drawn into the porous plug. The scandium may be provided on the plug, for example, in the form of a lump of scandium. For example, approximately 3% by weight of scandium is taken up in the plug. The plug is then cooled in hydrogen (step c) as a result of which it becomes brittle due to the fact that the scandium is partly converted into scandium hydride, so that an increase in volume occurs. The plug is then pulverized to form fragments (step d). The fragments are then heated in a molybdenum crucible in a hydrogen atmosphere up to 800° C. and kept at this temperature for approximately 15 minutes and slowly cooled in the same hydrogen atmosphere, substantially all the scandium being converted into scandium hydride (step e). The fragments are then ground in an agate mill to grains of the desired size (step f). Since scandium hydride is a stable compound the resulting powder may hence be stored in air.

Upon sintering a cathode matrix, the scandium hydride is decomposed (above 800° C.). Because scandium hydride has a larger specific volume than scandium, it is therefore to be preferred upon sintering and cooling in hydrogen, to remove the hydrogen at a temperature above 800° C. by pumping. Upon sintering in a vacuum this problem does, of course, not occur. However, in that case special measures must be taken to avoid excessive scandium evaporation. It is possible indeed upon sintering and cooling in hydrogen to obtain a good result when the powder manufactured in step (f) is provided as a top layer on the tungsten matrix, in particular when said powder is dehydrated or is mixed with 25 to 75% by weight of tungsten powder, preferably approximately 50% by weight of tungsten powder. Such a top layer preferably has a thickness which is smaller than 0.15 mm. As an impregnant in the cathodes to be described hereinafter, a conventional barium-calcium aluminate has been used. The whole or partial oxidation of the scandium present on the tungsten grains takes place during the manufacture of the cathode, for example, upon impregnating and/or activating. It is to be noted in this connection that scandium oxide thermodynamically is stabler than barium oxide.

Figure 2:
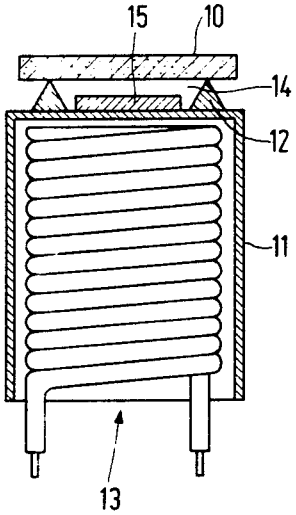

The invention will now be described in greater detail, by way of example, with reference to a number of specific examples and a drawing, in which FIG. 1 is a longitudinal sectional view of an impregnated cathode according to the invention, and FIG. 2 is a longitudinal sectional view of an L-cathode according to the invention.

FIG. 1 is a longitudinal sectional view of a scandate dispenser cathode according to the invention. The cathode body 1 having a diameter of 1.8 mm has been obtained by compressing a matrix having a top layer 2 from the powder according to step (f). This powder consists of tungsten grains which are covered at least partly with scandium hydride. After sintering and cooling, the cathode body 1 consists of an approximately 0.1 mm thick scandium oxide and scandium-containing porous tungsten layer on a porous tungsten layer having a thickness of approximately 0.4 mm. The cathode body is then impregnated with barium-calcium aluminate. Said impregnated cathode body, whether or not compressed in a holder 3, is welded on the cathode shank 4. A helical cathode filament 5 which may consist of a helically wound metal core 6 with an aluminum oxide insulation layer 7 is present in the cathode shank 4.

The recovery after ion bombardment of a cathode is important for use in various types of electron ray tubes. During the processing and/or during operation, cathodes in tubes are exposed to a bambardment of ions originating from residual gases. This recovery was measured at diodes having an anode which can be fired separately from the cathode in a high-vacuum arrangment. The emission is measured in a 1500 V pulse across the diode with a diode spacing (distance cathode-anode) of 300 || m. After activating the cathode in a vacuum, $10^{-5}$ torr argon were introduced into the system. With 1.5 kV pulse at the anode (10 Hz frequency) with such a pluse length that at the beginning the anode dissipation is 5 Watts, current was drawn for 40 minutes, said current gradually decreasing more or less. The cathode temperature (molybdenum brightness) was 1220° K. The argon was then removed by pumping. Recovery of the cathode then occurred at 1220° K. with a current of 1 A/cm$^2$ for 2 hours, succeeded by 1 hour at 1320° K. at 1 A/cm$^2$. During this recovery the current at 1500 V pulse on the anode was measured every 10 minutes and compared with the starting value. The said cycle of sputtering and recovery was then repeated once again. The current measured right after activation in a 1500 V pulse is indicated by $I(O)_{1500}$ and the value measured after the described two cycles by $I(e)_{1500}$. The ratio $I(e)_{1500}/I(O)_{1500}$ is a measure of the recovery H (%) after ion bombardment. Prior art cathodes and cathodes according to the invention sintered at various temperatures $T_s$(°C.) are compared with each other in the table below. In order to obtain a fair mutual comparison, it has been ensured that the porosity, i.e. the adsorbed quantity of impregnant (in the table in % by weight) was always the same, as well as possible, by varying the pressure with the sintering temperature in an adequate manner.

| | $P_s$ (atm) | $T_s$ (°C.) | Imp (wt. %) | $I_{1000}$ (mA) | H (%) |
|---|---|---|---|---|---|
| $Sc_2O_3$ + W top layer on W | 2 | 1900 | 4.2 | 3000 | 65 |
| 50% $ScH_2$/W + 50% W top layer on W | 4 | 1500 | 4.2 | 3000 | 80 |
| | 2.5 | 1800 | 4.2 | 2600 | 55 |

The matrices having a top layer of 50% $ScH_2$/W (i.e. W partly covered with $ScH_2$) mixed with 50% W showed a much more homogeneous scandium distribution than the known top layer having an $Sc_2O_3$+W (i.e. mixture of $Sc_2O_3$ grains and W grains). In addition, the recovery of a cathode manufactured with $ScH_2$/W and sintered at 1500° C. after ion bombardment is significantly better than for the known $Sc_2O_3$+W top layer cathode (H=80% as against H=65%). It also follows from this table how the sintering temperature for $ScH_2$/W cathodes influences the emission as measured in a 1000 V pulse and the recovery after ion bombardment. Sintering is preferably carried out at a temperature lower than the melting-point of scandium, namely 1541° C. Of course, the said influence is much smaller for cathodes having an $Sc_2O_3$+W top layer. The emission during a 1000 V pulse, also for $ScH_2$/W cathodes having a top layer on the W matrix of 25% of the $ScH_2$/W powder with 75% W powder and sintered at 1500° C., with approximately the same impregnant consumption, is again 3000 mA. This is the case also for an $ScH_2$/W top layer to which no W has been added and for a top layer consisting of a 1:1 mixture of $ScH_2$/W powder and W powder on a W matrix in which the material was compressed more heavily (impregant consumption 3%).

FIG. 2 is a longitudinal sectional view of an L-cathode according to the invention. The cathode body 10 has been compressed from a mixture of 25% $ScH_2$/W and 75% W and has been sintered. This cathode body 10 has been placed on a molybdenum cathode shank 11 having an upright edge 12. A cathode filament 13 is present in the cathode shank 11. A store 15 of emissive material (for example, barium-calcium aluminate mixed with tungsten) is present in the space 14 between the cathode body 10 and the cathode shank 11.

What is claimed is:

1. A method of manufacturing a scandate dispenser cathode having a matrix at least the top layer of which at the surface consists substantially of tungsten and scandium oxide ($Sc_2O_3$) and having emissive material in or below said matrix, said method comprising:

(a) compressing a porous plug of tungsten powder;

(b) heating said plug in a non-reactive atmosphere and in contact with scandium to above the melting temperature of scandium;

(c) cooling said plug in a hydrogen atmosphere;

(d) pulverizing said plug to fragments;

(e) heating said fragments to approximately 800° C. and firing them at said temperature in a hydrogen atmosphere for a few to a few tens of minutes and slowly cooling said fragments in said hydrogen atmosphere;

(f) grinding the resultant scandium hydride-tungsten ($ScH_2/W$) fragments to powder;

(g) compressing a matrix or a top layer on a matrix of pure tungsten from said $ScH_2/W$ powder or from a mixture of said powder with tungsten powder;

(h) then sintering and cooling one of said matrices to thereby form said cathode; and (i) introducing emissive material into said cathode.

2. A method as claimed in claim 1, wherein the plug in step (b) is heated in a vacuum.

3. A method as claimed in claim 1, wherein in step (b) the scandium is provided on the plug.

4. A method as claimed in claim 1, wherein step (h) is carried out in a hydrogen atmosphere and the hydrogen is removed by pumping at a temperature above 800° C.

5. A method as claimed in claim 1 or 2, wherein in step (g) the $ScH_2/W$ is provided in the form of a top layer on a tungsten matrix and that step (h) is carried out in hydrogen.

6. A method as claimed in claim 5, wherein the $ScH_2/W$ in the top layer is mixed with W, the mixing ratio being approximately 1:1.

7. A method as claimed in claim 5, wherein the thickness of the top layer is smaller than approximately 0.15 mm.

8. A method as claimed in claim 1, characterized in that step (h) is carried out in a vacuum.

9. A method as claimed in claim 1, wherein sintering is carried out at a temperature lower than the melting-point of scandium.

10. A method of manufacturing a powder consisting of tungsten grains which are covered at least partially with scandium hydride, said method comprising:

(a) compressing a porous plug of tungsten powder;

(b) heating said plug in a non-reactive atmosphere and in contact with scandium to above the melting temperature of scandium;

(c) cooling said plug in a hydrogen atmosphere;

(d) pulverizing said plug to fragments;

(e) heating said fragments to approximately 800° C. and firing them at said temperature in a hydrogen atmosphere for a few to a few tens of minutes and slowly cooling said fragments in said hydrogen atmosphere; and (f) grinding the resultant scandium hydride-tungsten ($ScH_2/W$) fragments to powder.

11. A method as claimed in claim 10, wherein in step (b) the plug is heated in a vacuum.

12. A method as claimed in claim 10, wherein in step (b) the scandium is provided on the plug.

* * * * *